US005398580A

United States Patent [19]

Gerhardt et al.

[11] Patent Number: 5,398,580

[45] Date of Patent: Mar. 21, 1995

[54] DEVICE FOR CUTTING A SHEET MATERIAL

[75] Inventors: Joergen Gerhardt, Dragoer; Ib Groenbjerg, Herlev, both of Denmark

[73] Assignee: Gerhardt International A/S, Kastrup, Denmark

[21] Appl. No.: 194,374

[22] Filed: Feb. 8, 1994

Related U.S. Application Data

[62] Division of Ser. No. 84,446, Jul. 1, 1993, Pat. No. 5,309,792, which is a division of Ser. No. 806,289, Dec. 13, 1991, abandoned.

[30] Foreign Application Priority Data

Sep. 26, 1991 [DE] Germany ..... 41 32 120.0

[51] Int. Cl.[6] ..... B26B 25/00; B26D 3/08

[52] U.S. Cl. ..... 83/880; 83/505; 83/676; 83/678; 83/886

[58] Field of Search ..... 83/13, 505, 676, 678, 83/695, 880, 881, 886, 884; 30/292

[56] References Cited

U.S. PATENT DOCUMENTS 3,827,340 8/1974 Keck et al. ..... 493/396
3,993,231 11/1976 Monteiro et al. ..... 225/96
4,217,683 8/1980 Roder et al. ..... 30/292
4,416,652 11/1983 Fischer et al. ..... 483/399

FOREIGN PATENT DOCUMENTS 0 045 714 2/1982 European Pat. Off. .
30 13 098 10/1980 Germany .
29 21 695 12/1980 Germany .
36 42 005 3/1988 Germany .
40 06 611 9/1991 Germany .
2 101 920 1/1983 United Kingdom .

*Primary Examiner*—Richard K. Seidel
*Assistant Examiner*—Raymond D. Woods
*Attorney, Agent, or Firm*—Foley & Lardner

[57] ABSTRACT

A device for cutting through, cutting into, perforating through or perforating into sheet material, such as papers, metal foils or plastic films, more particularly a label material disposed on a backing material which is not to be impaired, by means of a cutting disk which is to be detachably and coaxially clamped between a dolly disk and a pressure disk and the outside diameter of which is somewhat greater than the outside diameter of the dolly disk and of the pressure disk. The cutting disk is of such small thickness that the cutting work or perforating work can be carried out with its peripheral surface.

19 Claims, 4 Drawing Sheets

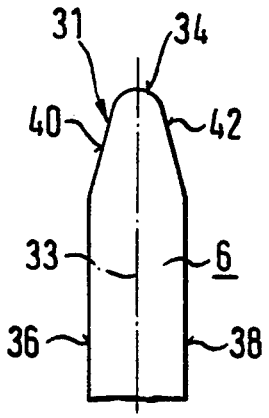
Fig. 2
Fig. 3
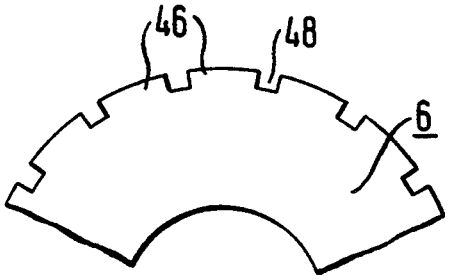
Fig. 4
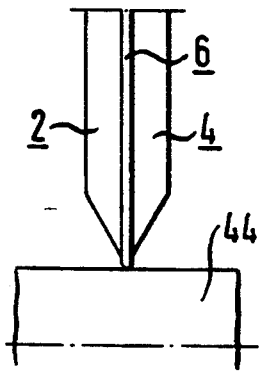

DEVICE FOR CUTTING A SHEET MATERIAL

The present application is a divisional of U.S. patent application Ser. No. 08/084,446, filed Jul. 1, 1993, now U.S. Pat. No. 5,309,792, issued May 10, 1994, which is a divisional of U.S. patent application Ser. No. 07/806,289, filed Dec. 13, 1991, now abandoned.

BACKGROUND OF THE INVENTION

The invention relates to a device for cutting through, cutting into, perforating through or perforating into sheet material, such as papers, metal foils or plastic films, more particularly a label material disposed on a backing material which is not to be impaired, by means of a cutting disk which is to be detachably coaxially clamped between a dolly disk and a pressure disk and the outside diameter of which is somewhat greater than the outside diameter of the dolly disk and of the pressure disk.

In the case of a known device of this kind according to German Offenlegungsschrift 30 13 098, the cutting disk is equipped at its periphery with a cutter. During the cutting operation or perforating operation, the cutter is subjected to considerable wear resulting in increasingly less sharp (dull) cut edges or perforation edges in the sheet material, such that the cutting disk has to be replaced relatively frequently.

OBJECTS AND SUMMARY OF THE INVENTION

The object of the invention is to specify a cutting device of the kind discussed above, the cutting disk of which is less susceptible to wear.

In accordance with a first aspect of the invention, a device for cutting sheet material is provided which comprises a dolly disk, a pressure disk, and a cutting disk which is detachably and coaxially clamped between the dolly disk and the pressure disk. The cutting disk has a radial diameter which is greater than diameters of the dolly disk and the pressure disk, and has a thickness which is sufficiently small to allow a peripheral surface thereof to perform a cutting operation. "Cutting", within the context of the invention, is to be understood to encompass cutting through, cutting into, perforating through, or perforating into the sheet material. "Sheet material" is to be understood to encompass papers, metal foils or plastic films, or a label disposed on a backing material which is not to be impaired by the cutting disk.

In accordance with a preferred aspect of the invention, the thickness of the cutting disk is between 0.08 and 0.15 mm, and is preferably between 0.10 and 0.13 mm.

In accordance with another preferred aspect of the invention, a rotatable dolly roller supports the sheet material on a side of the sheet material which faces away from the cutting disk. The dolly roller preferably has a peripheral surface which is composed of hardened steel.

Another object of the invention is to provide a process of manufacturing annular cutting disks, comprising the steps of punching blanks of the cutting disks from a metal plate, then placing a plurality of the blanks on a shaft adjacent to one another, and then clamping the plurality of blanks to one another to form a pack. Subsequent steps include rotating the shaft and grinding the blanks of the pack to produce cutting disks, then individually conveying the cutting disks through an etching system which sprays the cutting disks from above and below with an etching liquid, and then washing and drying the cutting disks.

In accordance with a preferred aspect of the invention, a further step is provided of forming grooves in the peripheral areas of the disks having a depth of between 0.20 mm and 0.25 mm, and preferably having a depth of between 0.21 mm and 0.24 mm.

Other objects, features and advantages of the present invention will become apparent to those skilled in the art from the following detailed description. It should be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The above and further objects of the invention will become more readily apparent as the invention is more clearly understood from the detailed description to follow, reference being had to the accompanying drawings in which like reference numerals represent like parts throughout, and in which:

FIG. 2 shows an enlargement of the area II in FIG. 1.

FIG. 3 shows—not according to scale—a peripheral area of a perforation disk from the line of vision III in FIG. 1.

FIG. 4 shows, in diagrammatic form, the interaction between a device according to FIG. 1 in the assembled state while it cooperates with a dolly roller.

DETAILED DESCRIPTION OF THE PREFERRED EMBODIMENTS

In order to achieve the objects of the invention, a device is provided having a cutting disk which is of such small thickness that the cutting work or perforating work can be carried out with its peripheral surface.

With this achievement of the object, the invention was based on the discovery that even a cutting disk having a rounded-off peripheral surface can perform cutting work and perforating work, that a rounded-off peripheral surface of this type has a relatively low susceptibility to wear and, even after wear, is still able to perform uniformly tidy cutting work or perforating work, provided only that it is of sufficiently small thickness.

Figure 1:
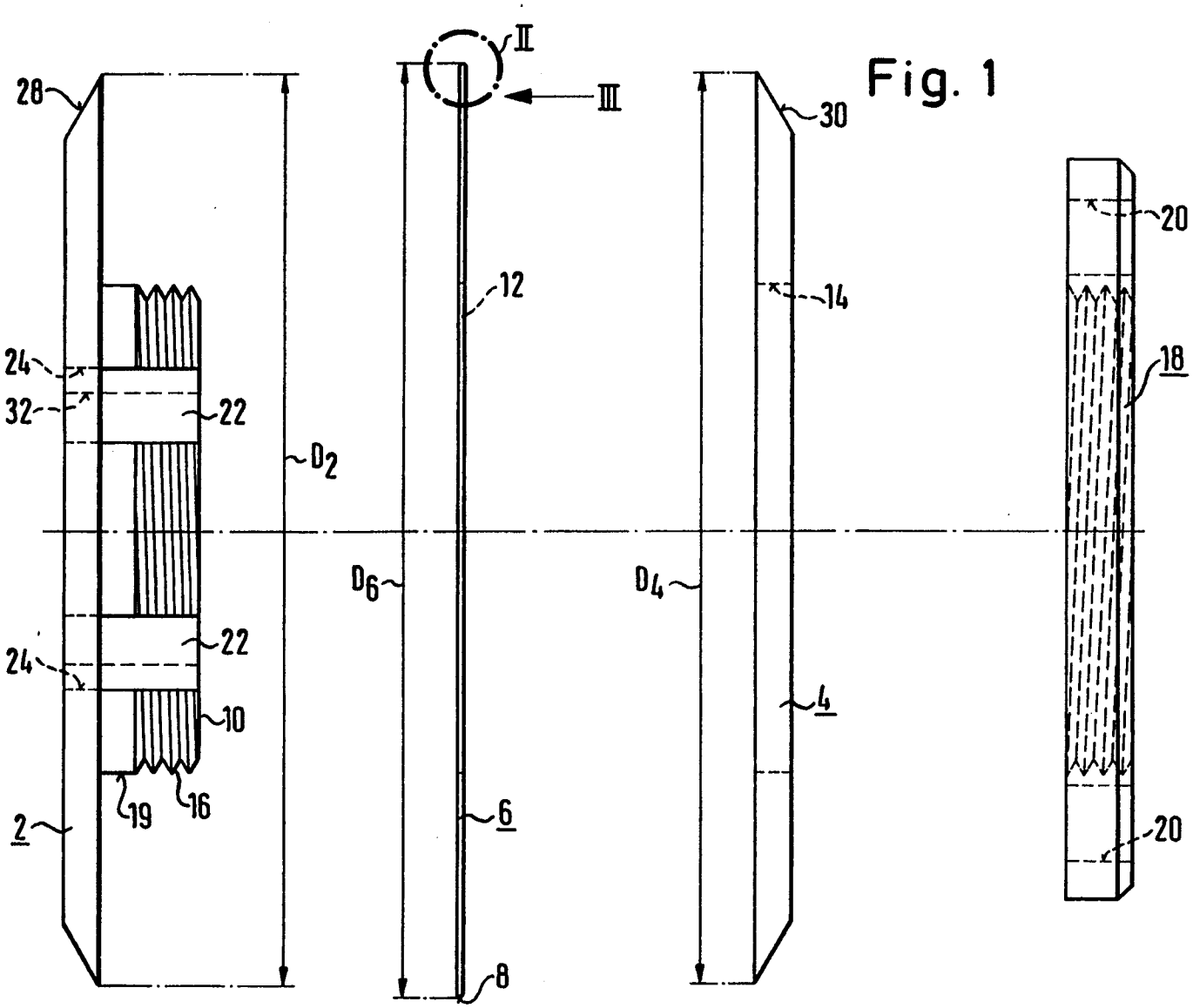
FIG. 1 shows a device for the clamping-in of a cutting disk in exploded representation.

FIG. 1 shows a dolly disk 2 with a predefined outside diameter and a pressure disk 4 with essentially the same outside diameter. An annular cutting disk 6 is removably clamped coaxially between the dolly disk 2 and the pressure disk 4. Cutting disk 6 has a periphery 8 which protrudes all around slightly beyond the outside diameters of the dolly disk 2 and of the pressure disk 4. Cutting disk 6 is preferably composed of carbon steel or chromium steel. The dolly disk 2 exhibits a hub 10 which passes through a central hole 12 in the cutting disk 6, and a central hole 14 in the pressure disk 4 and is equipped with an external thread 16 for the screwing-on of a pressure ring 18. In the pressure ring 18 are holes 20, into which a turning tool can be inserted and applied. The periphery of the hub 10, positioned axially adjacent the dolly disk 2, is configurated as a guide surface 19 for the central hole 12 in the cutting disk 6. The hub 10 exhibits, in its periphery, four axial rotation-inhibiting recesses 22 which merge into the bores 24 passing through the dolly disk 2. Two of these rotation-inhibiting recesses 22 interact with rotation-inhibiting projections of the cutting tool which jut or project radially inward into the hole 12 of the cutting disk 6. The dolly disk 2 and the pressure disk 4 are bounded at their peripheries by conical surfaces 28, 30, the bases of which face one another. A roller bearing (not shown) is provided in a central hole 32 of the hub 10 and is adapted to be mounted onto a bearing axle.

As shown in FIG. 2 in cross-section, the peripheral surface 31 provided at the periphery 8 of the cutting disk 6 runs essentially symmetrical to the center plane 33 of the cutting disk 6 and is rounded off in its summit area 34. Converging flanks 40, 42 lead to the summit area 34 from the lateral surfaces 36 and 38 of the cutting disk 6. In the cross-section shown, these converging flanks 40, 42 are straight. The outside diameter $D_6$ of the cutting disk 6 is somewhat greater than the outside diameter $D_2$ of the dolly disk 2 or greater than the outside diameter $D_4$ of the pressure disk 4, depending upon which of these outside diameters $D_2$, $D_4$ is the greater.

It is preferred, in this connection, that the peripheral surface should, from the outset, i.e. prior to initial usage of the cutting disk, run in cross-section essentially symmetrical to the center plane of the cutting disk and should be rounded off in the summit area.

Due to the small thickness of the cutting disk, it is preferred that the outside diameter of the cutting disk should be 0.50 mm to 0.70 mm, preferably 0.55 mm to 0.65 mm, greater than the outside diameter of the dolly disk or of the pressure disk, depending upon which of these outside diameters is the greater, in order that the peripheral surface implementing the cutting work or perforating work is securely guided in its operation.

Particularly for cutting through label material on a backing material, but also in other cases, it has been found that the thickness of the cutting disk should measure 0.08 to 0.15 mm, preferably 0.1 to 0.13 mm.

FIG. 3 shows the peripheral area of a cutting disk 6 designed with perforation bars 46. The perforation bars 46 are separated from one another by gaps 48. The dimensions of the bars 46 and of the gaps 48 can be adjusted without difficulty to the requirements which have been set in each case.

It has been shown that the cutting disk works particularly reliably if the sheet material which is to be cut or perforated is supported by a rotatably mounted dolly roller on the side facing away from the cutting disk. At the same time, the peripheral surface—if not the entire body—of the dolly roller is preferably composed of hardened steel. To this end, FIG. 4 shows that the cutting disk 6 interacts with the peripheral surface of a rotatably mounted dolly roller 44, which acts as support for the back of the sheet material and, where applicable, for the backing of the sheet material.

A particularly economical process for the manufacture of the discussed cutting disks, but also/or of cutting disks which do not satisfy the thickness requirement of the cutting disks described above, includes punching blanks 52 of the annular cutting disks 6 from a metal plate via a conventional punching device 70, placing a plurality of these blanks as a pack directly adjacent to one another onto a shaft, clamping them together on the shaft and, as a pack, circularly grinding them as the shaft is rotated via a conventional grinding device 72. Then the circularly ground cutting disks are individually conveyed horizontally through an etching system 74 in which they are sprayed from above and below with an etching liquid, and the circularly ground and etched grinding disks are then washed and dried in conventional device(s) 76.

For the manufacture of perforation disks of the type, illustrated in FIG. 3, the circularly ground, etched, washed and dried grinding disks, in particular, are placed as a pack directly adjacent to one other onto a shaft and are clamped together on the shaft. Then, axial grooves of a depth of 0.20 mm to 0.25 mm, preferably 0.21 mm to 0.24 mm, are ground or milled into the pack in the peripheral area via a grinding or milling device forming a groove forming device 78.

Figure 5:
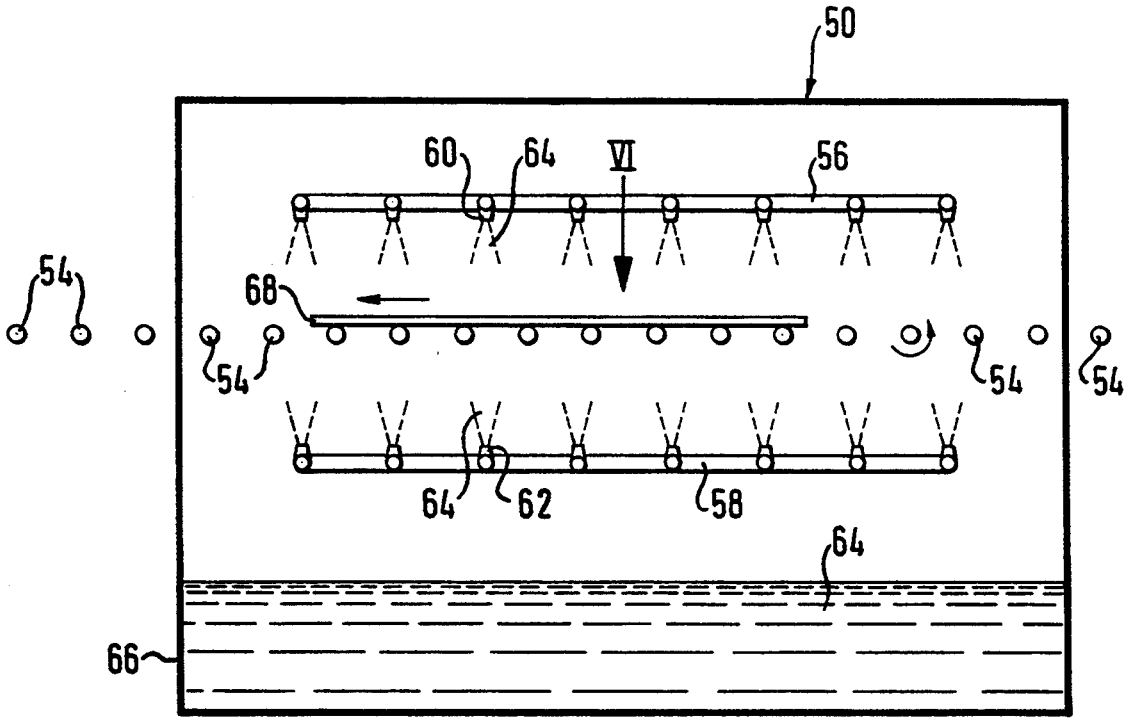
FIG. 5 shows an elevational view of an etching device in longitudinal section.
Figure 6:
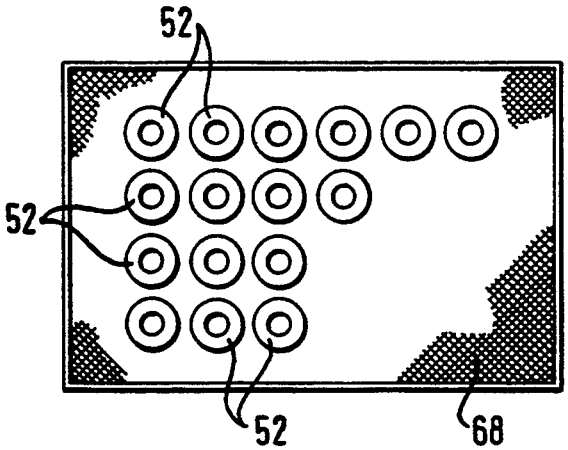
FIG. 6 shows a plan view of a blanks-bearing grating of the etching device, along the line of vision VI of FIG. 5.
Figure 7:
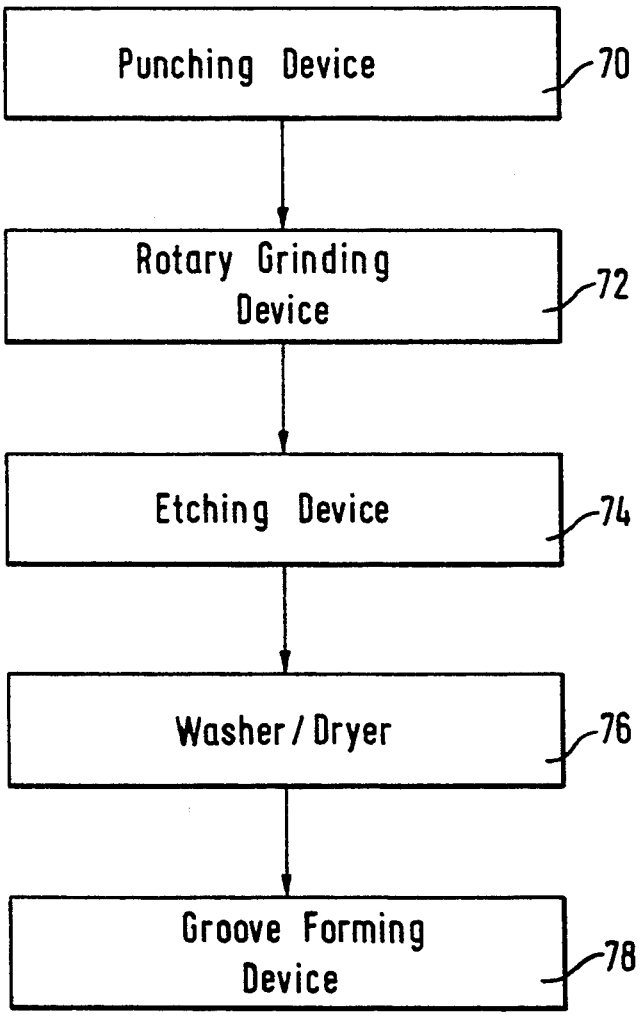
FIG. 7 schematically illustrates a system for manufacturing a cutting disk, the system including the devices of FIGS. 5 and 6.

The etching device according to FIG. 5, used for manufacturing cutting disks 6, exhibits a housing 50 having an inlet slit, not shown, and an outlet slit, not shown, for blanks 52 to be punched on both sides. These blanks 52 have been previously punched from a metal plate and are conveyed individually, i.e., separated from and detached from one another, on a grating 68 through the housing 50. In front of the housing, in the housing, and behind the housing, the grating 68 is horizontally supported by rollers 54. Distributing pipes 56 and 58 for downwardly or upwardly directed nozzles 60, 62 are provided in housing 50. Etching liquid 64 for the spraying of the blanks 52 issues from above and below out of nozzles 60, 62. The etching liquid 64 accumulates in the floor area 66 of the housing 50 and, in a manner not shown, for example, by a conventional pumping arrangement, and is recycled back to the nozzles 60, 62.

What is claimed is:

1. A device for cutting sheet material, comprising:

(A) a dolly disk;

(B) a pressure disk; and (C) a cutting disk which is detachably and coaxially clamped between said dolly disk and said pressure disk, said cutting disk having a diameter which is greater than the larger of the diameters of said dolly disk and said pressure disk, wherein said cutting disk has two lateral surfaces that are substantially parallel to a center plane of said cutting disk and a peripheral surface with a cross section substantially symmetric to said center plane;

wherein said peripheral surface has a rounded summit area and two straight flanks which are oblique to said center plane, said flanks connecting said rounded summit area with said two lateral surfaces; and wherein said cutting disk has a thickness which is sufficiently small to allow said peripheral surface thereof to perform a cutting operation.

2. The device as claimed in claim 1, wherein said diameter of said cutting disk is between 0.50 and 0.70 mm greater than the larger of the diameters of said dolly disk and said pressure disk.

3. The device as claimed in claim 3, wherein said diameter of said cutting disk is between 0.55 and 0.65 mm greater than the larger of the diameters of said dolly disk and said pressure disk.

4. The device as claimed in claim 2, wherein said thickness of said cutting disk is between 0.08 and 0.15 min.

5. The device as claimed in claim 4, wherein said thickness of said cutting disk is between 0.10 and 0.13 mm.

6. The device as claimed in claim 1, wherein said cutting disk is composed of one of carbon steel and chromium steel.

7. The device as claimed in claim 1, further comprising a rotatable dolly roller for supporting said sheet material on a side of said material which faces away from said cutting disk.

8. The device as claimed in claim 7, wherein said dolly roller has a peripheral surface which is composed of hardened steel.

9. The device as claimed in claim 1, wherein said peripheral surface is provided with axial grooves.

10. The device as claimed in claim 9, wherein the depth of said axial grooves is between 0.20 mm and 0.25 mm.

11. The device as claimed in claim 10, wherein the depth of said axial grooves is between 0.21 mm and 0.24 mm.

12. The device as claimed in claim 1, wherein the device for cutting is a device for performing, with respect to said sheet material, a function selected from the group consisting of: cutting through, cutting into, perforating through, and perforating into.

13. The device as claimed in claim 1, wherein the sheet material is selected from the group consisting of paper, metal foil, plastic film, and a label material disposed on a backing.

14. A method of cutting sheet material, comprising:

(A) providing a cutting disk which is detachably and coaxially clamped between a dolly disk and a pressure disk, said cutting disk having a diameter which is greater than the larger of the diameters of said dolly disk and said pressure disk;

wherein said cutting disk has two lateral surfaces that are substantially parallel to a center plane of said cutting disk and a peripheral surface with a cross section substantially symmetric to said center plane;

wherein said peripheral surface has a rounded summit area and two straight flanks which are oblique to said center plane, said flanks connecting said rounded summit area with said two lateral surfaces; and (B) cutting said sheet material with a peripheral surface of said cutting disk.

15. The method as claimed in claim 14, wherein said step (B) includes the step of cutting said sheet material with said cutting disk having a thickness which is between 0.08 and 0.15 mm.

16. The method as claimed in claim 15, wherein said step (B) includes the step of cutting said sheet material with said cutting disk having a thickness which is between 0.10 and 0.13 mm.

17. The method as claimed in claim 14, wherein said step (A) includes the step of providing said peripheral surface with axial grooves.

18. The method as claimed in claim 17, wherein said step (A) includes the step of providing said grooves to a depth between 0.20 mm and 0.25 mm.

19. The method as claimed in claim 18, wherein said step (A) includes the step of providing said grooves to a depth between 0.21 mm and 0.24 mm.

* * * * *